United States Patent [19]

Weinberg et al.

[11] Patent Number: 4,971,666

[45] Date of Patent: Nov. 20, 1990

[54] REDOX REACTIONS IN AN ELECTROCHEMICAL CELL INCLUDING AN ELECTRODE COMPRISING MAGNELI PHASE TITANIUM OXIDE

[76] Inventors: Norman L. Weinberg, 95 Chasewood La., East Amherst, N.Y. 14051; John D. Genders, 27 Partridge Walk, Lancater, N.Y. 14086; Robert L. Clarke, 74 Muth St., Orinda, Calif. 94563

[21] Appl. No.: 506,807

[22] Filed: Apr. 10, 1990

Related U.S. Application Data

[62] Division of Ser. No. 270,186, Nov. 14, 1988, Pat. No. 4,936,970.

[51] Int. Cl.[5] ..... C25B 1/00; C25B 1/24; C25B 3/00

[52] U.S. Cl. ..... 204/59 R; 204/73 R; 204/78; 204/86; 204/89; 204/94; 204/95; 204/291; 204/292

[58] Field of Search ..... 204/59 R, 73 R, 78, 204/86, 89, 94, 95, 291, 292

[56] References Cited

U.S. PATENT DOCUMENTS 4,422,917 12/1983 Hayfield ..... 206/196
4,701,146 10/1987 Fujita et al. ..... 204/130

*Primary Examiner*—John F. Niebling
*Assistant Examiner*—David G. Ryser
*Attorney, Agent, or Firm*—Cushman, Darby & Cushman

[57] ABSTRACT

An electrochemical cell including an electrode comprising Magneli phase titanium oxide is disclosed for use with reduction oxidation reactions. The use of the Magneli phase titanium oxide electrode advantageously inhibits certain redox back reactions.

7 Claims, 3 Drawing Sheets

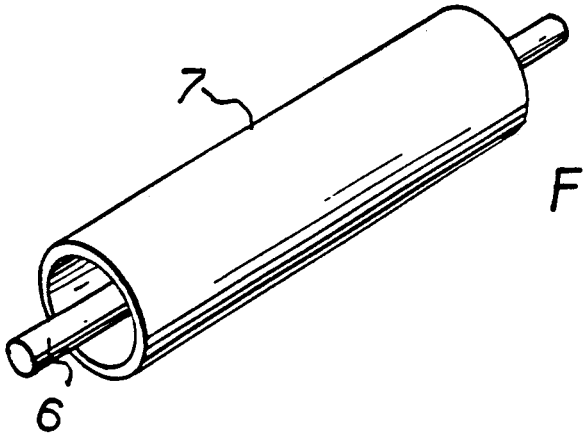
(PRIOR ART)
FIG. 3A
(PRIOR ART)
FIG. 3B
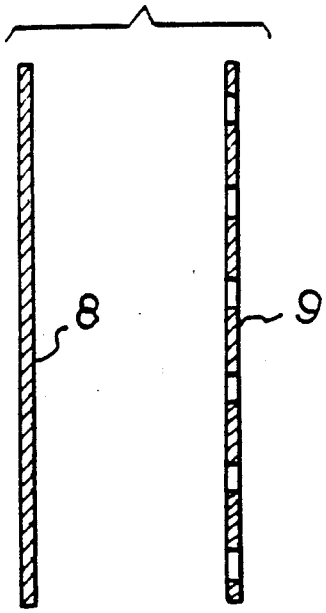
(PRIOR ART)
FIG. 3C
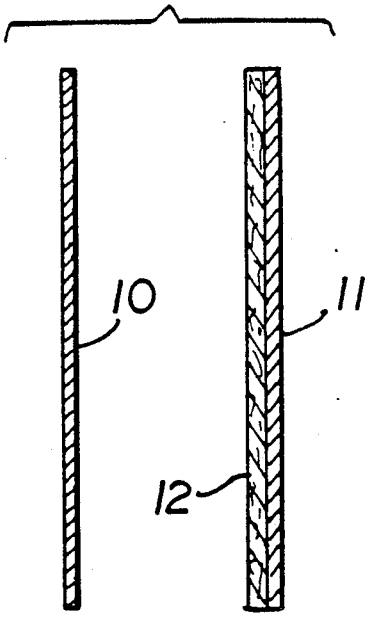

REDOX REACTIONS IN AN ELECTROCHEMICAL CELL INCLUDING AN ELECTRODE COMPRISING MAGNELI PHASE TITANIUM OXIDE

This is a division of application Ser. No. 07/270,186, filed Nov. 4, 1988, now U.S. Pat. No. 4,936,970.

BACKGROUND OF THE INVENTION

1. Field Of The Invention

This invention relates to electrochemical reduction-oxidation reactions which occur in electrolytic solutions at electrodes comprising Magneli phase titanium oxide and an apparatus for performing such reactions. For ease of reference this class of reactions will be generally referred to as soluble "redox" reactions, that is, those reactions where both oxidized and reduced species are stable and/or soluble in the reaction solution. Such reactions may be contrasted to those where one of the oxidation or reduction products is either a solid or a gas which would immediately separate from the electrochemical solution in which it was formed.

Magneli phase titanium oxides are those of the general formula $Ti_xO_{2x-1}$, where x is a whole number 4–10. Such oxides have ceramic type material properties, but are nevertheless sufficiently conductive to be used as electrodes. Thus, electrodes formed from these oxides will sometimes be generally referred to herein as "ceramic" electrodes. The utility of these materials in electrochemical applications has only recently come to light, and their properties in particular instances are only now being investigated.

The present invention is specifically directed to redox reactions in which it is normally desired to obtain the most efficient electrochemical conversion of a less desirable soluble species to a more desirable oxidation or reduction reaction product in solution. Since electrochemical processes are electron transfer reactions that occur at the electrode, activity in the bulk of the electrolyte away from the electrodes is generally confined to migration to or from the electrodes and mixing of the species in the solution. The activity within a few molecular diameters of the electrodes is the area in which the electron transfer reactions take place. This interface area has been the subject of much study in an effort to modify the behavior of species in the solution so as to optimize the electrochemical process. The use of electrocatalytic coatings, enhanced turbulence, increased electrode surface area and other strategies have been applied with some success.

When such a means of enhancing the efficiency of a reaction has been identified then a strategy must be developed for minimizing the back reaction of the desired species to its original state. This is a natural problem, since the oxidation and reduction reactions occur virtually simultaneously at the opposing electrodes in an electrolytic solution. Approaches to this problem include the separation of the electrodes by use of a partitioned cell, i.e., one in which a membrane or diaphragm separates the anolyte from the catholyte. The use of a smaller electrode for the reaction at which the reversion, or back reaction, occurs is also known, so as to form a greater volume of the desired reaction product at the larger electrodes.

By identifying efficient electrode materials and the most appropriate electrochemical cell design for a given redox reaction, profitable industrial processes for the production of or recovery of valuable chemical constituents can be developed. Currently these processes are used for metal plating, metal recovery, electric storage batteries, electrowinning and fine chemical and dyestuff manufacture, among others.

2. Description of Related Art

The art of use of electrochemical redox reagents in electrochemical processing is very well documented. Early references go back over 80 years in European technical literature. The use of cerium sulfate and chromic acid as a 'Sauerstoffubertrager' or oxygen carrier, dates back to patent DRP No. 172654 (1903) for the manufacture of organic quinones. In this process cerium salts were added to the electrolyte. It was realized that cerium ion could be oxidized at a lead dioxide anode. The oxidizing agent produced is then reacted with anthracene to form anthraquinone. Ceric ion is reduced to the cerous state to be reoxidized at the anode once more and so act as a shuttle species between the anode and the insoluble organic substrate.

Reference to the contemporary literature shows that the uses of redox reagents in electrochemical processes is quite extensive. See Indirect Electrochemical Processes, Clarke, R. L., Kuhn, A. T., Okoh, E. Chemistry in Britain 59, 1975, Mantell, C. L. Industrial Electrochemistry, McGraw-Hill, New York. Baizer, M. M. (1973) Organic Electrochemistry, Marcel Dekker, New York. Weinberg, N. L. (ed) (1975) Techniques of Chemistry, Vol. 5 techniques of Electroorganic Synthesis, Parts I and II, John Wiley and Sons, Chichester and New York.

Redox reagents have been used in organic reduction processes such as the use of small amounts of tin to improve the yield of para-amino phenol from nitrobenzene by reduction at a cathode. The oxidation of toluene to benzaldehyde with manganese III in strong acid, the manganese III ion is generated at the anode, from manganese sulfate the product of the toluene oxidation process. More recently iron redox has been used to oxidize coal and other carbonaceous fuels to carbon dioxide, water and humic acid, See Clarke R. L. Foller Journal of Applied Electrochemistry 18 (1988) 546–554 and cited references. In this study, ferric ion in sulfuric acid was used as the redox reagent to oxidize carbonaceous fuels such as coke. In the process ferric ion was reduced to ferrous which is easily reoxidized to ferric at the anode. This ferrous to ferric oxidation occurs at potentials well below the oxygen evolution potential of the anode and is thus energy saving with respect to its use in the formation of hydrogen from water.

The presence of redox reagents in an electrochemical process is not always beneficial. In the electrochemical recovery of silver from photographic solutions, iron in the solution interferes with the cathodic deposition of the silver. Ferric ion competes with silver for electrons at cathode and is preferentially reduced to ferrous ion, such that the presence of small quantities of iron will reduce the efficiency for silver deposition below 20%.

The use of specific redox reagents in electrochemical reactions both as aids, or as the principle reactant is well understood by those skilled in the art. The present invention, however, concerns the use of specific electrodes to manipulate the redox effect to great advantage, that is, to be able to manipulate the choice of electrode material to promote a particular redox effect and/or reduce the effect at the counter electrode.

Electrode materials have usually been chosen from a group of metals such as platinum, nickel, copper, lead, mercury and cadmium. Additional choices might include irridium oxide and lead dioxide. The choice of electrode material is predicated on its survival in a particular electrolyte, and the effect achieved with the reagents involved. For example, to oxidize cerium III ion a high oxygen overpotential electrode is usually chosen such as lead dioxide. Some electrode materials are unable to oxidize cerium which requires an electrode potential of 1.6 volts as the oxygen overpotential of the metal electrode is too low, examples would be platinum and carbon. To reduce many organic substrates lead electrodes are chosen which has a very high hydrogen overpotential. Low hydrogen overvoltage electrodes such as platinum, nickel, iron, copper, etc. allow the hydrogen recombination reaction at the surface to occur at potentials too low to be effective as reducing cathodes for many organic substrates.

More recently conductive ceramics for use in certain electrochemical applications have been described. U.S. Pat. No. 4,422,917 describes the manufacture of Magneli phase titanium oxides and suggests the use of these materials in electrodes for certain electrochemical applications. This patent describes the properties and method of manufacture of a group of substoichiometric titanium oxides of the formula $TiO_x$, where x ranges from 1.67 to 1.9. More specifically, it is taught at column 13, lines 27 to 32 that anodes of such titanium oxides coated with specified metals "may be satisfactory for use in redox reactions such as the oxidation of manganese, cerium, chromium and for use as products in the oxidation of organic intermediates."

In addition to the art describing efficient electrode materials, many publications describe electrochemical cell designs which seek to minimize redox back reactions and therefore optimize a process using an electrode efficient for a particular reaction.

Many examples of specific cell designs are to be found in the literature which attempt to reduce the back reaction. Robertson et al, Electrochimica Acta, vol. 26, No. 7, pp. 941–949, 1981, describe a cell system in which a porous membrane is used to cover the cathode of a hypochlorite generator to reduce the reduction of hypochlorite at the cathode to chloride. This same system was used to oxidize manganese to manganate and cerous to ceric. The system works by inhibiting the mixing of the bulk of the electrolyte at the electrode interface. A porous felt cover would allow escape of hydrogen into the electrolyte, and a concentration gradient would be set up with respect to the products of oxidation in the bulk of the electrolyte compared to access to the cathode. Alternatively, the cell can be designed with a small counter electrode with respect to the anode or viceversa. An example of this is described in Industrial Electrochemistry (1982) D. Pletcher, Chapman Hall, New York. See pages 145–151. Other descriptions of cell design strategies are to be found in Electrochemical Reactor Design (1977) D. J. picket, Elsevier, Amsterdam, and Emerging Opportunities for Electro-organic processes (1984), Marcel Decker, New York.

The fundamental method of dealing with back reactions is to operate a divided cell system, by inserting a membrane or diaphragm between the anode and cathode. The problem with this strategy is the cost of the electrochemical cell and its supporting equipment is much higher than in the case of an undivided cell. Further the cell voltage is higher due to the increased IR drop through the electrolyte and membrane, which also increases operating costs.

Thus, even the higher efficiency cell designs have their drawbacks. Complicated cell designs require a greater number of components, and this may become very expensive on an industrial scale. Systems which use a large electrode opposing a smaller electrode are undesirable since high voltages are required.

For these reasons a need has arisen for a redox system wherein an efficient electrode can be used, but which does not require a complicated cell design to prohibit the shuttling of the desired chemical species from the electrode at which they are formed to the opposing electrode to be reconverted to their original form.

SUMMARY OF THE INVENTION

During observations of the properties of ceramic electrodes in redox reactions it has now been unexpectedly found that, rather than exhibiting efficient conversion performance, Magneli phase titanium oxide material used as a redox electrode provides surprisingly inefficient performance in such reactions. By inefficient it is meant that such electrodes inhibit the back reaction of a product which has been formed at an adjacent electrode. In fact, it has now been determined that such electrodes inhibit the efficiency of certain redox reactions to such an extent that the electrodes can be used as counter electrodes to minimize redox back reactions. This property of ceramic electrodes in redox reactions provides the wholly unexpected advantage of being able to eliminate the need for complex electrolytic cell designs for an important group of industrially important redox reactions.

Thus, in one embodiment, the present invention provides a method of performing a redox reaction in an electrochemical cell including an electrode comprising substoichiometric titanium oxide as an inhibiting counter electrode to an electrode efficient for the conversion of an ionic species in an electrolytic solution. The redox reagent may be inorganic or organic in nature. This method has been found to be particularly advantageous for the reactions of $Fe^{2+}$ to $Fe^{3+}$, $I^-$ to $I_2$, $Cr^{3+}$ to $Cr^{6+}$, $Ce^{4+}$ to $Ce^{3+}$, $Mn^{2+}$ to $Mn^{3+}$, $Co^{2+}$ to $Co^{3+}$, as well as for $Sn^{4+}$ to $Sn^{2+}$. Organic redox reagents such as quinone/hydroquinone may also be used. That is, it has been found that by using a substoichiometric titanium oxide electrode as a counter electrode for such reactions, the back reactions which would otherwise normally occur in the electrolyte are advantageously minimized.

The invention further comprises an electrochemical cell for soluble reduction-oxidation reactions wherein an electrode formed from substoichiometric titanium oxide is used as a counter electrode to one which efficiently converts ions, such as those listed above, to desirable redox products. In both the inventive method and electrochemical cell, it is further preferred to use substoichiometric titanium oxide of the formula $TiO_x$, where x is in the range 1.67 to 1.9, i.e., the conductive ceramic material disclosed in U.S. Pat. No. 4,422,917. In the inventive method or apparatus, any electrode material which is efficient for a particular redox reaction may be used as the "efficient" electrode. For example, electrodes comprising lead dioxide, platinum, platinum-irridium, irridium oxide, ruthinium oxide, tin oxide and the like may be used.

Further, it has been found that, for redox reactions wherein ethylenediamine tetraacetic acid (EDTA) is used as a supporting anion, the oxidation of such EDTA (as would normally be expected) is inhibited to a great extent by the use of an electrode of substoichiometric titanium oxide ceramic.

There are many advantages to a redox reaction system in which efficient conversion of an ionic species to a desired chemical product occurs at one electrode while the counter electrode is inefficient for, or inhibits, the back reaction of that product to the original ionic species. For example, product solutions of greater purity can be made without need for separation of the anolyte and catholyte in the electrochemical cell. Additionally, the elimination of a membrane or compromised cell geometry (large anode, small cathode or vice-versa) reduces overall cell voltage and therefore operating cost. Electrolyte management is simplified when only one stream is used. Recycled electrolytes that are separated by a membrane are troubled by water and sometimes ionic transport across the membrane. This has to be corrected chemically and could involve some loss of reagent.

Importantly, however, the present invention does not achieve such advantages at the cost of an increase in the amount of energy needed for a given redox reaction. On the contrary, while the substoichiometric titanium oxide counter electrode of the present invention is properly referred to as "inefficient" when the back reaction of desirable products is concerned, the electrode is not electrically inefficient. In fact, it is the beneficial electrical and corrosion resistance and in particular the high oxygen and hydrogen overpotentials of the ceramic of such electrode materials which would, under normal circumstances, lead one to expect that such materials would also perform as efficient redox electrodes. Thus, the anomalous characteristics of such electrodes which have now been identified are all the more surprising.

BRIEF DESCRIPTION OF THE DRAWINGS

The present invention will be better understood by reference to the appended drawings wherein:

FIG. 3 shows various types of known cathode/anode configurations.

DETAILED DESCRIPTION OF THE PREFERRED EMBODIMENTS

The invention will now be described with reference to the drawings.

Figure 1:
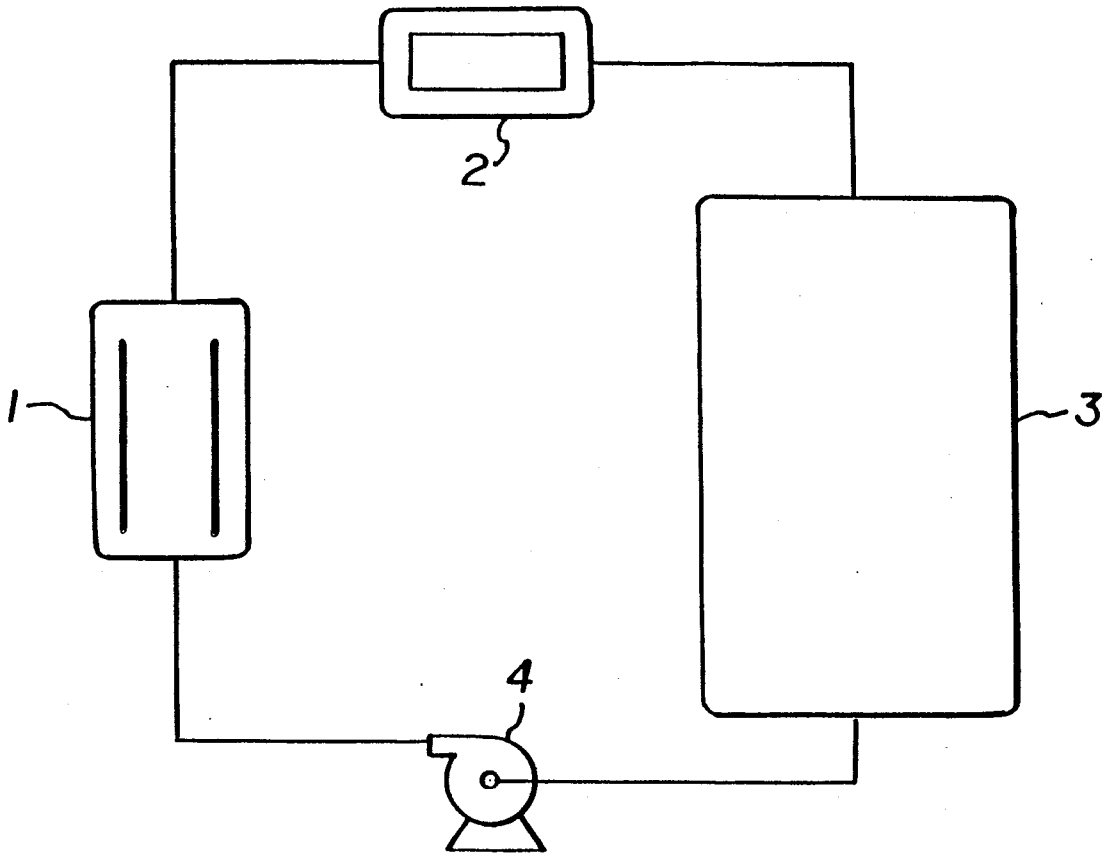
FIG. 1 is schematic diagram of a single electrolytic cell suitable for performing redox reactions.

FIG. 1 shows a schematic diagram of an electrolytic process of an undivided cell producing a redox species at the anode or cathode. Undivided cell 1 is fitted with an anode and a cathode, each of the electrodes being of equal size. In the present invention, one of these electrodes would comprise titanium oxide conductive ceramic. Heat exchanger 2 balances the heat generated by the reaction, and holding vessel 3 acts as storage for the electrolyte. Circulating pump 4 circulates the electrolyte back to cell 1. In this process if an electrode of substoichiometric titanium oxide is not used, the back reaction of a desired product species would obviously occur in cell 1 unless one assumes that the back reaction is insignificant, i.e. either the product is deposited at the anode or cathode or the reverse electrode is inactive. Some examples of this situation do exist such as the production of manganese dioxide which deposits on the anode. Thus, the present invention is directed to those redox couples which are soluble or stable in the electrolyte used.

Figure 2:
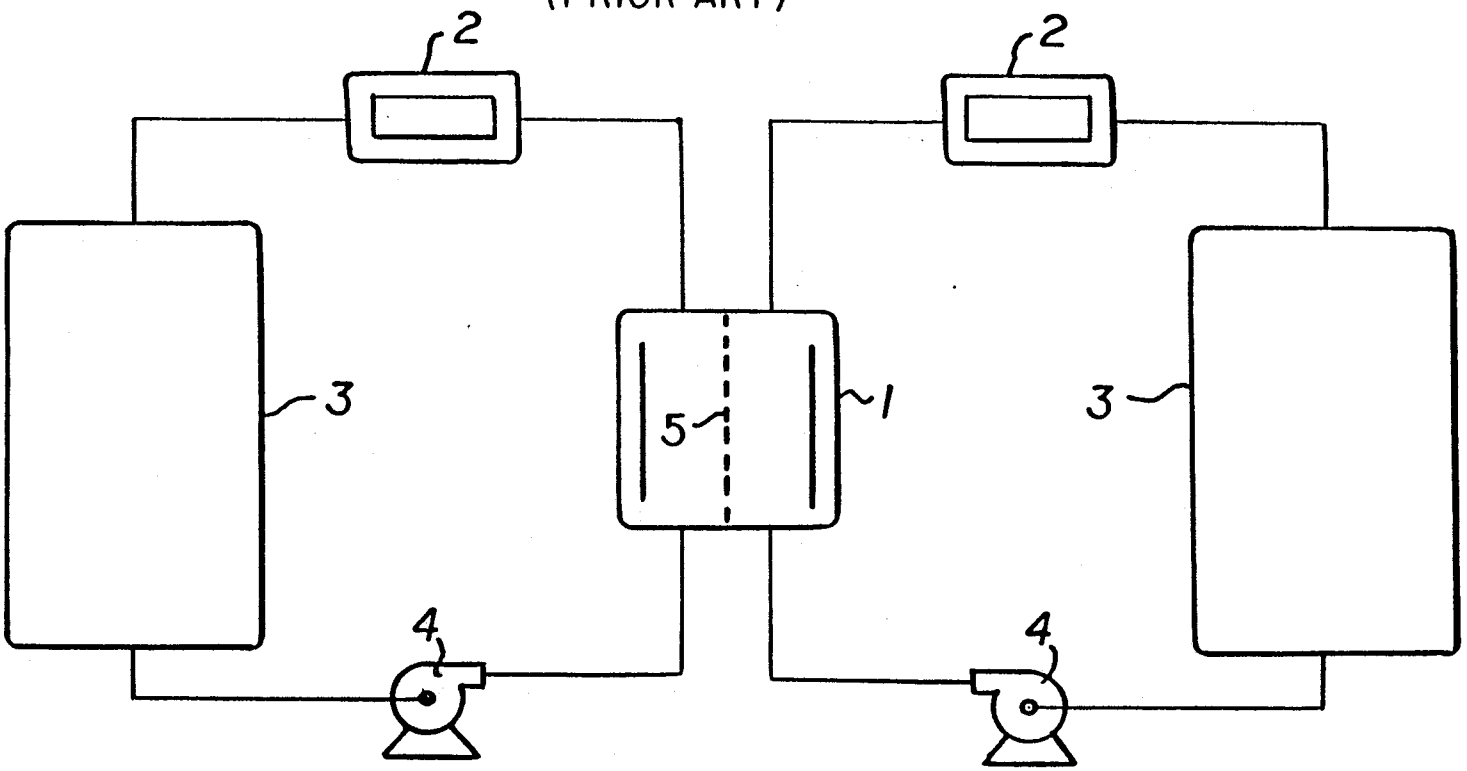
FIG. 2 (PRIOR ART)
FIG. 2 is likewise a schematic electrolytic cell, however this figure shows a prior art divided cell.

FIG. 2 shows the same type of process in a divided cell, of the prior art with separated electrolyte streams, as would be normally used to enhance the separation of the desired product by minimizing its exposure to the opposing electrode. The same reference numbers are used for the components of the system as in FIG. 1. In this case there are two tanks 3, two pumps 4 and two heat exchangers 2, plus a more complicated cell 1 containing an expensive membrane 5. This system is much more common. It is the basis of the manufacture of chlorine and caustic soda, the regeneration of chromic acid as a redox reagent, and a variety of electroorganic synthesis processes. Comparison of FIG. 2 with FIG. 1 makes clear the greater expense involved with operating such a system.

FIG. 3A, 3B and 3C show examples of known alternative strategies for minimizing the back reaction which are more process specific. In FIG. 3A a small rod cathode 6 and large tube anode 7 are shown. Such a structure has been used in electrochlorinator devices for swimming pools. The small surface area cathode 6 is less likely to reduce hypochlorite due to the high gassing rate; the cell voltage is higher than would be the case with a better engineered system. Opposing electrodes 8 and 9 of FIG. 3B, a large surface area anode and a coarse mesh cathode respectively, can be used to achieve the same effect as with cathode 6 and anode 7, but using parallel plate geometry. Finally the combination of electrodes 10 and 11 of FIG. 3C represent the system used by Robertson et al. and Clarke et al. As can be seen, an interference diaphragm 12 is positioned at electrode 11 to prevent reduction of cerium there. Thus, the present invention has the advantage of avoiding the need for such specialized cell configurations.

It should be noted that the substoichiometric titanium oxide material used as an electrode material herein does not, in and of itself, form a part of the present invention, since this material and the method of making it are previously known. To make such material for use in the present invention the reader is directed to the disclosures of U.S. Pat. No. 4,422,917 concerning formulation and method of manufacture, for which purpose the disclosure of that patent is fully incorporated herein by reference.

The unexpected inhibiting effect of the substoichiometric titanium oxide electrodes for certain important ionic species is shown by the following, this data being set forth by way of exemplification, and the invention is not to be considered as being limited to these examples.

EXAMPLE 1

In a cell configured as shown in FIG. 2, i.e., fitted with an anode and cathode of identical surface area and separated by a membrane, the oxidation of ferrous ion to ferric was studied. In the first case a graphite anode was used, Spectrotech graphite rod 7.85 sq. cm in surface area. The cathode was platinum coated titanium, and the separator was a Neosepta AFN-32 anionic membrane.

The anolyte was 0.1 M Ferrous Ammonium Sulfate in 0.1 M sulfuric acid. The current density at the anode was 18 mA sq. cm.

A second experiment was identical in all respects to the first except the graphite anode was replaced by a ceramic anode of identical surface area. In each case 620 coulombs was passed through an identical volume of electrolyte. In the graphite anode case 5.53 moles of ferrous iron was converted to ferric, a current efficiency of 86.1%. In experiment 2, 1.52 moles of ferrous iron was converted to ferric, a current efficiency for the ceramic as an anode in this experiment of 23.6%.

This experiment shows a wholly unexpected result for the ceramic in view of the fact that graphite is an indifferent electrode as an oxidizing anode for iron and it still outperformed the ceramic electrode which has a much higher overpotential and no propensity to be oxidized by ferric ion.

EXAMPLE 2

In a cell configured as FIG. 1, i.e., with a simple undivided cell, an electrolyte containing 0.084 mols of $Ce^{4+}$/0.084 M $Ce^{3+}$ was electrolyzed between a lead dioxide on lead anode and a graphite cathode at a current density of 20 mA sq. cm.

In an identical experiment in the same cell fitted with a ceramic electrode as described in this disclosure, operating at the same current density, 1192 coulombs were passed.

The concentration of $Ce^{4+}$ declined in both cases as the cathode effect was stronger than the oxidizing effect of the anode, however the graphite electrode reduced the ceric ion by 68% whereas the ceramic electrode despite its higher overpotential reduced the ceric ion by only 10%. This implies that the ceramic cathode would be effective as a non-reactive cathode in the cerium regeneration process whereas a graphite cathode would require some type of separation strategy.

EXAMPLE 3

In a cell configured as FIG. 2, fitted with a Nafion (DuPont) membrane a ceramic anode and a platinum irridium cathode were used to electrolyze a chromium sulfate solution containing 0.1 M chromium III and 3 M sulfuric acid. The current density was 20 mA sq. cm. After the passage of 1172 coulombs of electricity the current efficiency of the oxidation process was calculated to be only 12% compared to a literature figure of 90% for a lead oxide anode system used under these conditions.

This experiment implies that a ceramic anode would be useful as a chromium plating anode using the chromium sulfate organic brightener combination, as the ceramic anode would convert the chromium ion to the unwanted hexavalent state.

Graphite is an alternative electrode to the ceramic for this process, however, in tests used to measure the relative effect the graphite electrodes were severely corroded and oxidized making their use in this process unacceptable.

EXAMPLE 4

In a simple undivided cell used for the recovery of copper, an electrolyte of ethylene diamine tetra acetic acid (EDTA) of 45 g/liter concentration was used as the supporting anion for the copper cation. Copper was deposited on the cathode during the passage of 2562 coulombs of electricity such that all the copper was essentially stripped from the solution. The anode was made from the conductive ceramic disclosed in this invention.

At the end of the experiment the concentration of EDTA left was estimated by quantitative analysis techniques using strontium nitrate and aqueous ortho cresolphthalein indicator in aqueous methanol. The concentration of EDTA was the same as at the beginning of the experiment within experimental error.

This experiment on the stability of EDTA at a ceramic electrode was repeated in a divided cell as in FIG. 2 three times and the concentration of EDTA tested after each passage of current. No decline in the amount of EDTA was detected using the analytical technique described above.

Normally one would expect the EDTA to be oxidized severely as is the case with graphite or platinum electrodes, especially as the ceramic has a much higher oxygen overpotential.

EXAMPLE 5

In a divided cell as in FIG. 2 a solution of 2500 ppm of sodium chloride was passed over the ceramic anode and cathode pair of electrodes of equal surface area. The current density was 115 mA sq. cm. The current efficiency of the generation of chlorine as hypochlorite was estimated at 20% during the operation of the cell. It should be understood that the overpotentials for chlorine liberation and oxygen liberation for this ceramic under these conditions is very close and the availability of oxygen is much greater than chloride ion at this concentration. The same current efficiency for chlorine generation is measured when the experiment is run with 3% salt.

In a third experiment using molar potassium iodide as the anolyte feed solution the current efficiency for iodine formation was measured as 62.7% compared to 82.3% using a graphite anode. This experiment does not follow the pattern shown by the previous examples, we might have forecast the current efficiency for the liberation of iodine to follow the case of chlorine and been significantly lower. The fact that this did not occur indicates that the effect is unrelated to the gassing overpotentials of the ceramic electrode.

These examples indicate that the behavior of the ceramic electrode does not follow the accepted pattern of the conventional electrodes. The fact that the material has a high gassing overvoltages and resists oxidation and reduction changes at the surface does not forecast its performance as an oxidizing or reducing electrode. This high overvoltage may in fact be a manifestation of the poor electron transfer kinetics at the surface for both types of reaction, redox or gas release.

These anomolous effects, which have great utility in undivided cell systems using inorganic or organic redox reagents and/or organic substrates were not predicted. In fact, using the old criteria for prediction of utility it was expected that the ceramic would have been a very efficient processing electrode for producing the required species such as chromium VI from chromium sulfate solutions as suggested in the prior art concerning utility as a processing electrode. There was no anomaly shown in the generation of hypochlorite from salt solutions that would suggest this behavior or the experiments on the deposition of metals onto the surface of the ceramic.

What is claimed is:

1. A method of performing a redox reaction in an undivided electrochemical cell comprising the steps of:

disposing a first electrode in a liquid electrolyte solution, said first electrode being at least 80% efficient for the oxidation or reduction of inorganic or organic redox couples in said liquid electrolyte solution;

simultaneously disposing a second electrode in said electrolyte solution as a counterelectrode to said first electrode, said second electrode being formed of substiochiometric titanium oxide of the formula $TiO_x$, where x is in the range 1.67 to 1.9; and applying a potential across said electrodes so as to oxidize or reduce the desired component of said redox couples.

2. A method as in claim 1, wherein said inorganic and organic redox couples are selected from the group consisting of $Fe^{2+}/Fe^{3+}$, $I^-/I_2$, $Cr^{3+}/Cr^{6+}$, $Ce^{4+}/Ce^{3+}$, $Mn^{2+}/Mn^{3+}$, $Co^{2+}/Co^{3+}$, $Sn^{4+}/Sn^{2+}$, $Cl^-/OCl^-$, quinone/hydroquinone and compatible combinations thereof.

3. The method as in claim 2 wherein said redox couple is $Fe^{2+}/Fe^{3+}$ and said liquid electrolyte solution is a silver containing photographic solution.

4. The method as in claim 1 wherein said first electrode comprises lead dioxide, platinum, platinum-iridium, iridium oxide, ruthenium oxide and tin oxide.

5. The method as in claim 1 wherein said liquid electrolyte solution also contains a complexing agent.

6. The method as in claim 5 wherein said complexing agent is EDTA.

7. The method of performing a redox reaction in an undivided electrochemical cell comprising the steps of:

disposing a first electrode in a liquid electrolyte solution, said first electrode being efficient for the oxidation or reduction of inorganic or organic redox couples in said liquid electrolyte solution;

simultaneously disposing a second electrode in said liquid electrolyte solution as a counter electrode to said first electrode, said solution containing at least one redox couple and a complexing agent, said second electrode being formed of substiochiometric titanium oxide of the formula $TiO_x$, where x is in the range 1.67 to 1.9; and applying a potential across said electrode so as to oxidize or reduce the desired components of said redox couples.

* * * * *